US005515944A

United States Patent [19]

Cappi et al.

[11] Patent Number: 5,515,944

[45] Date of Patent: May 14, 1996

[54] CHECK-OUT COUNTER FOR SUPERMARKETS

[75] Inventors: Angelo Cappi, Vignola; Renato Rimondi, Bazzano, both of Italy

[73] Assignee: A. W. A. X. Progettazione E Ricerca s.r.l., Vignola, Italy

[21] Appl. No.: 247,818

[22] Filed: May 23, 1994

[30] Foreign Application Priority Data

Jun. 8, 1993 [IT] Italy ..... MI93A1203

[51] Int. Cl.[6] ..... A47F 9/04

[52] U.S. Cl. ..... 186/61; 186/68

[58] Field of Search ..... 186/61, 66, 68, 186/69

[56] References Cited

U.S. PATENT DOCUMENTS

| | | | |
|---|---|---|---|
| 3,651,890 | 3/1972 | Potrafke | 186/68 |
| 4,401,189 | 8/1983 | Majewski | 186/68 |
| 4,953,664 | 9/1990 | Vrooman et al. | 186/66 X |
| 5,178,234 | 1/1993 | Sakurai et al. | 186/68 X |

FOREIGN PATENT DOCUMENTS

| | | | |
|---|---|---|---|
| 363335 | 4/1990 | European Pat. Off. | 186/66 |
| 484299 | 5/1992 | European Pat. Off. | 186/66 |

*Primary Examiner*—F. J. Bartuska

*Attorney, Agent, or Firm*—Panitch Schwarze Jacobs & Nadel

[57] ABSTRACT

A check-out counter for supermarkets and the like, including a cashier station (2) before which a conveying device (6) is located and next to which, on each side, a scanner (3) provided with a monitor (4) and connected to a keyboard (5) for the items manual recording is positioned, as well as a mobile barrier (12) and a photocell (16) both being connected to the scanner (3) and suitable to control the access to a bag-dispensing device (18) placed next to the conveying device (6).

14 Claims, 2 Drawing Sheets

CHECK-OUT COUNTER FOR SUPERMARKETS

The present invention concerns mixed-type check-out counters for supermarkets, i.e. with two stations for the self-service recording by the customers and an intermediate station for the cashier. In particular, the invention concerns a check-out counter of said type suitable to be placed side by side with two bag-dispensing devices and including a barrier protecting the access to the bags and a scanner with relevant monitor and keyboard, as well as a conveying device situated before the cashier station.

It is known that check-out counters of the above-cited mixed type have recently been introduced in supermarkets and similar points of sale, also including a pair of devices for dispensing plastic bags to the customers and allowing them to easily introduce the purchased items in said bags kept open by the device. Such a check-out counter is described, for example, in the Italian patent application n. MI91A002353 in the name of the Applicant. Said known counter, in which the cashier station is situated between two conveyor belts in series, while significantly reducing the formation of queues at the check-out, yet is not free from drawbacks. In fact, the cashier is positioned behind the scanner monitors directed towards the customers, i.e. out of her visual range. If the customers make mistakes or do not promptly understand the meaning of the message appearing on the monitor, the cashier cannot properly help them. Moreover, the presence of the conveyor belt and of the bag-dispensing device side by side between the cashier and the customer often makes the payment operations difficult because of the distance from the cashier to the customer, especially when bulky items are placed on the conveyor belt.

Therefore, the object of the present invention is to provide a mixed-type check-out counter, wherein the cashier position is such as to allow her to better assist the customer. This object is achieved according to the present invention by means of a check-out counter having the characteristics cited in claim 1.

The check-out counter according to the present invention has the advantage of allowing the vision of the monitor, besides to the customer, also to the cashier, so that she can easily check both the customer's operations and the messages on the monitor.

Another advantage of the check-out counter according to the present invention is that the distance between the cashier and the customer is so short as to allow the cashier to cooperate in a quick and complete way with both customers using her counter simultaneously. At the same time, the customers can carry out all the operations concerning the recording and payment of the purchased goods without inconvenient movements.

Figure 1:
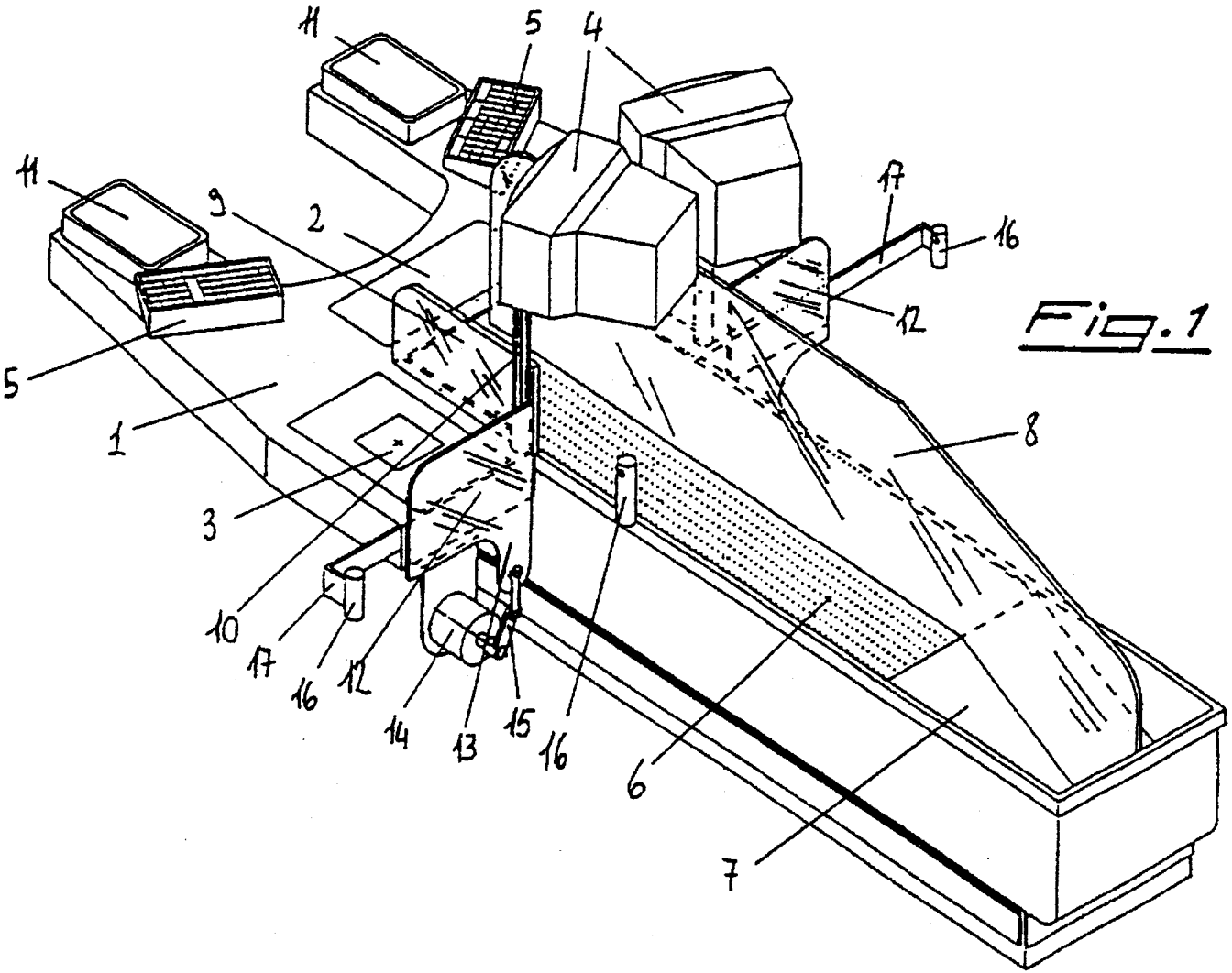
Figure 2:
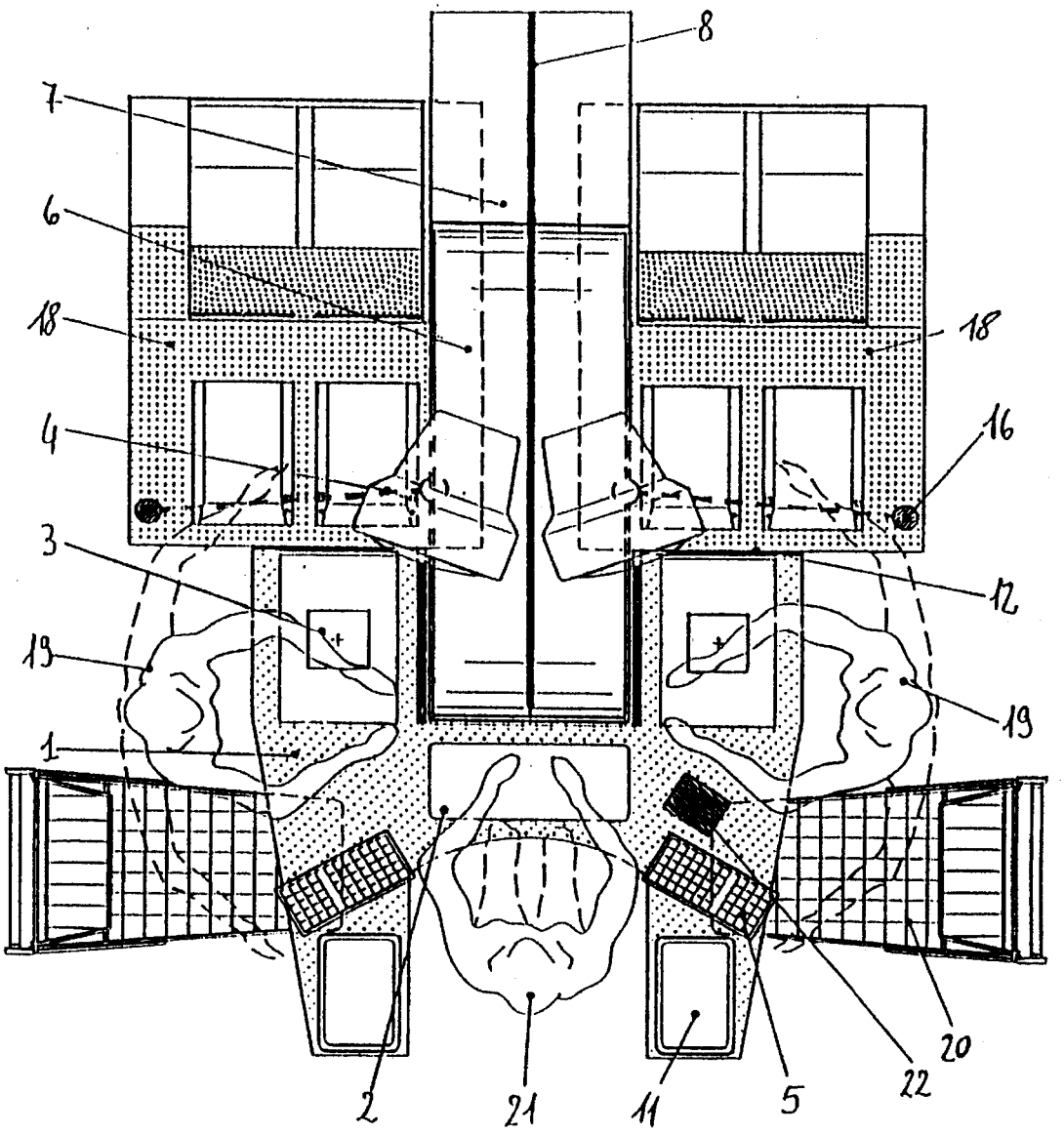

These and other advantages and characteristics of the check-out counter according to the present invention will be apparent to those skilled in the art from the following detailed description of a preferred embodiment thereof referring to the annexed drawings wherein:

FIG. 1 shows a perspective view of the check-out counter according to the present invention; and FIG. 2 shows a top plan view of the same check-out counter of FIG. 1 provided with two bag-dispensing devices.

Referring to FIG. 1, there is seen that the check-out counter according to the present invention includes a top 1 in whose central portion a cashier station 2 of known type is positioned. A scanner 3 provided with a monitor 4 which is preferably situated in a position at 40–50 cm above top 1 is located on each side of station 2. Scanner 3 is embedded in top 1 and is of a known type, so that it does not require a detailed description.

A mobile barrier whose structure and function will be described later on is positioned to the right of scanner 3. A keyboard 5 for the manual recording of the items is to the left of scanner 3 and connected thereto.

A conveyor belt 6 to convey the items recorded by the cashier to a collecting trough 7, situated at the end of belt 6, is located before cashier station 2, between the two scanners 3. A partition 8 extends along the center line of belt 6 and extends also in trough 7, thus longitudinally dividing both belt 6 and trough 7 so as to avoid the mixing up of the items of the two customers simultaneously operating on the two sides of the check-out counter according to the present invention. The conveyor belt 6 is of a known type so that it does not require further description..

A dividing panel 9, preferably transparent, separates each scanner 3 from belt 6 and extends up to the edge of top 1, so as to prevent the customer from using belt 6 which thus can be used by the cashier only.

A supporting post 10 holding monitor 4 in a raised position directed towards top 1 is located by panel 9, so that the monitor can be seen not only by the customer standing before scanner 3, but by the cashier sitting at the cashier station 2 as well. Post 10, as mentioned above, is long enough so that monitor 4 does not hinder the passage of bulky items which the cashier lays down on belt 6 after having recorded them.

Furthermore, room for additional devices is provided on top 1, to the left of keyboard 5, such as, for example, scales 11 to weigh and price loose items, a cash slip printer, etc.

The edge of top 1 next to scanner 3 is closed by a mobile barrier 12, preferably made of a transparent material, which has a lower extension 13 for the connection to a motor 14 through a link 15. By means of this mechanism, the mobile barrier 12 can rise and lower according to the controls received, as it will be explained in detail later on.

Right beyond the mobile barrier 12 there is located a photocell 16, whose first member is placed by the edge of belt 6 and the second member is situated, by means of a horizontal support 17, in a position at 20–30 cm from the outer edge of the mobile barrier 12. All the elements making up the protective barrier are of a known type and therefore are not further described.

Referring now to the top plan view of FIG. 2, there is seen how the check-out counter according to the present invention may be provided with suitable bag-dispensing devices which can be either of manual or automatic type. The latter are obviously mostly preferred for their rapidity and ease of use.

In the embodiment illustrated in FIG. 2, there is considered to employ a pair of automatic devices 18 of the type described in the Italian patent n.1.236.811 granted to the Applicant. They are provided with a double loading hopper, they are placed by the edge of top 1 and also serve as a support for the outer members of the two photocells 16. The two devices 18 are placed very near one to the other so that belt 6 and trough 7 partially hide them as indicated by the dotted lines.

Barrier 12, when it is in the raised position, prevents any object present on top 1 from being pushed into the loading hoppers of device 18. Moreover, photocell 16 reports the passage of objects climbing over or going around barrier 12, as it will be described in detail later on.

The operation of the check-out counter according to the present invention during the recording, bagging and paying steps of the items purchased in the supermarket will now be described in detail.

Each customer 19 picks up the items from his cart 20 and passes them one by one over scanner 3 for the self-service recording. As soon as the item is recorded by scanner 3, the latter is deactivated, the mobile barrier 12 lowers and photocell 16 is deactivated from the checking function. In this way, photocell 16 does not react to the blanking so that customer 19 can cross it with his hand and introduce the recorded item in the bag or in the loading hopper of the automatic device 18.

When customer 19 retracts his hand, photocell 16 is illuminated again and thus controls the reactivation of scanner 3 and the simultaneous raising of barrier 12. Therefore, customer 19 can resume the recording of the items on scanner 3.

The items not suitable to be introduced into the bags, due to bulkiness, weight, fragility or other reasons, are given by customer 19 to cashier 21 which records them directly in cart 20 or on top 1 by means of a mobile scanner (not shown), for example of the pen type. Thanks to the nearness of cashier 21, at any time customer 19 can not record an item 22 by means of scanner 3, he can put it down on top 1 and let cashier 21 try to record it by means of her mobile scanner. In the exceptional case not even said scanner can read the bar code of item 22, cashier 21 records the item manually by means of keyboard 5 provided on top 1 for this purpose. The items recorded by cashier 21 are then placed by the cashier herself on belt 6 which takes them to the collecting trough 7.

If customer 19 tries to introduce an item into the bag without recording it, barrier 12 remains in the raised position and prevents the passage of the customer's hand. If he tries anyway to get around barrier 12 to introduce into the bag an item not recorded, the photocell, which has not received the consent signal by scanner 3, reacts to the blanking and controls the emission of an acoustic signal as well as the appearance of an alarm message on monitor 4.

Upon completion of the items recording, customer 19 pushes a specific button (not shown) to indicate the operation end and to request the presentation of the total amount to pay, then effects the payment and goes on to the other end of the check-out counter to take the filled bags and the items possibly present in trough 7.

It is apparent that the working of the above-illustrated check-out counter implies the presence of processing units or the like which coordinate the various members, and being of a known kind are not described here.

The illustrated embodiment is clearly just an example, in that many modification obvious for those skilled in the art may be made thereto. A first change may consist in replacing belt 6 with a similar device suitable to convey the items to trough 7, such as for example a motor-driven series of rollers, or with two parallel independent belts. Another change may consist in the integration of the two keyboards 5 into a single keyboard placed before the cashier and provided with a switch to charge from time to time to one customer or the other the sum of the items recorded manually by means of said single keyboard.

Many modifications can also be provided for the mobile barrier 12, both for its driving mechanism and for the barrier structure as well. In fact, it may be made like a door, rather than guillotine-like, hinged at the top or at the bottom or on one side, so as to open and close by rotating around a vertical or horizontal axis. Also, multiple doors may be used, possibly sized so that the mobile barrier 12 extends for the whole width of the bag-dispensing device.

We claim:

1. A check-out counter for supermarkets and the like, including a cashier station (2) located upstream of a conveying device (6), a bagging area (18), at least one scanner (3) provided with a monitor (4) positioned proximate to the cashier station (2), a mobile barrier (12) as well as a photocell (16), both being connected to the scanner (3) and suitable to control access to the bagging area (18), characterized in that the mobile barrier (12) comprises a panel moving with a vertical reciprocating motion.

2. A check-out counter according to claim 1, characterized in that the scanner (3) with the monitor (4), the mobile barrier (12) and the photocell (16) are in pairs and each set is arranged by one side of station (2).

3. A check-out counter according to claim 1, characterized in that the conveying device (6) consists in a conveyor belt.

4. A check-out counter according to claim 1, characterized in that a keyboard (5) is connected to the scanner (3).

5. A check-out counter according to claim 1, characterized in that a dividing panel (9) separates the scanner (3) from the conveying device (6).

6. A check-out counter according to claim 1, characterized in that a partition (8) longitudinally divides the conveying device (6) and a collecting trough (7) positioned at the end thereof.

7. A check-out counter according to claim 2, characterized in that the conveying device (6) comprises a conveyor belt.

8. A check-out counter according to claim 2, characterized in that a keyboard (5) is connected to the scanner (3).

9. A check-out counter according to claim 3, characterized in that a keyboard (5) is connected to the scanner (3).

10. A check-out counter according to claim 2, characterized in that a dividing panel (9) separates the scanner (3) from the conveying device (6).

11. A check-out counter according to claim 3, characterized in that a dividing panel (9) separates the scanner (3) from the conveying device (6).

12. A check-out counter according to claim 2, characterized in that a partition (8) longitudinally divides the conveying device (6) and a collecting trough (7) positioned at the end thereof.

13. A check-out counter according to claim 3, characterized in that a partition (8) longitudinally divides the conveying device (6) and a collecting trough (7) positioned at the end thereof.

14. A check-out counter according to claim 4, characterized in that a partition (8) longitudinally divides the conveying device (6) and a collecting trough (7) positioned at the end thereof.

* * * * *